US005460366A

United States Patent [19]

Pugh

[11] Patent Number: 5,460,366

[45] Date of Patent: Oct. 24, 1995

[54] GOLF BALL RETRIEVER

[76] Inventor: Anthony Pugh, 6 Wells Road, Baglan, Port Talbot, West Glamorgan, United Kingdom

[21] Appl. No.: 316,202

[22] Filed: Sep. 29, 1994

[30] Foreign Application Priority Data

Jan. 7, 1994 [GB] United Kingdom ..... 9400195

[51] Int. Cl.[6] ..... A63B 47/02; A63B 57/00

[52] U.S. Cl. ..... 273/32 F; 294/19.2

[58] Field of Search ..... 273/32 B, 32 F, 273/34; 294/19.2

[56] References Cited

U.S. PATENT DOCUMENTS

| | | | |
|---|---|---|---|
| 1,504,934 | 8/1924 | Brown | 273/34 R |
| 2,750,222 | 6/1956 | Borah | 294/19.2 |
| 3,922,026 | 11/1975 | Schweitzer | 294/19.2 |
| 4,313,632 | 2/1982 | King | 294/19.2 |
| 4,787,632 | 11/1989 | Nigrelli | 273/32 B |

FOREIGN PATENT DOCUMENTS

| | | | |
|---|---|---|---|
| 501523 | 7/1956 | Italy | 294/19.2 |
| 21000 | of 1900 | United Kingdom | 294/19.2 |
| 2128484 | 5/1984 | United Kingdom . | |
| 2246517 | 2/1992 | United Kingdom . | |

*Primary Examiner*—William H. Grieb
*Attorney, Agent, or Firm*—Edwin D. Schindler

[57] ABSTRACT

A golf ball retriever comprises a club engaging portion 14 to enable the retriever to be secured to the butt end of a golf club and a ball receiving portion 2 capable of engaging and retaining a golf ball. The ball receiving portion comprises a pair of spaced arms which are resiliently deformable relative to one another as the retriever is pushed down onto a golf ball, such that the ball is gripped between the arms. The arms are bifurcated to form respective claws 7 terminating in pointed ends which serve to contact the dimples on the surface of the golf ball to steady and locate the ball below the retriever prior to gripping.

14 Claims, 2 Drawing Sheets

FIG. 1
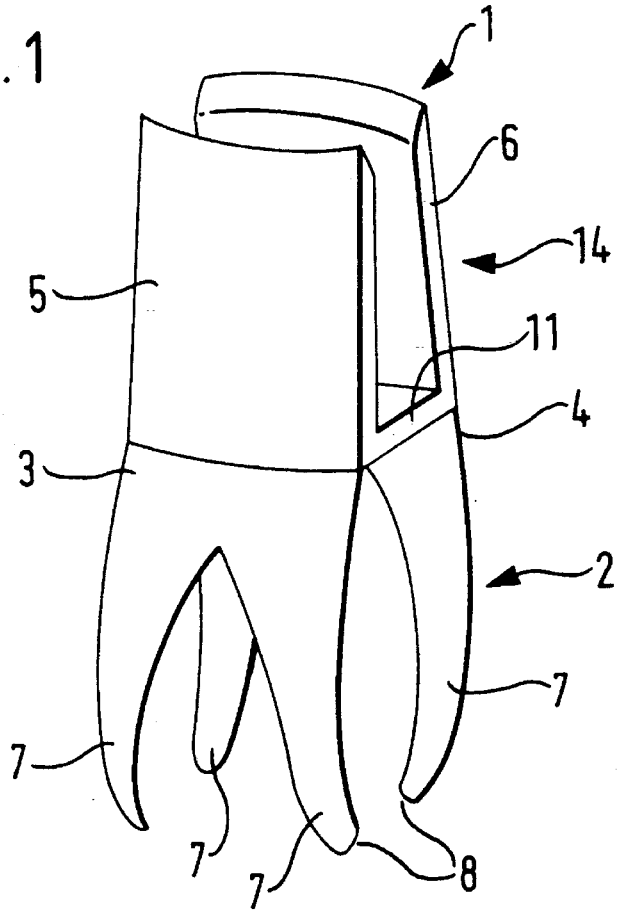
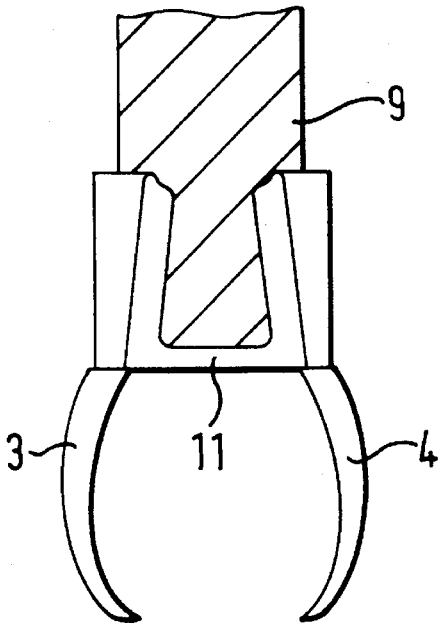
FIG. 2
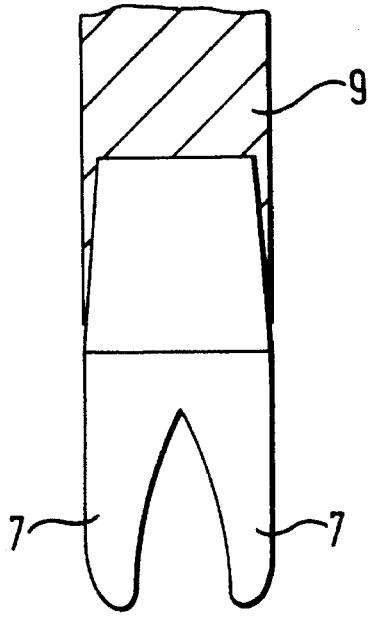
FIG. 3

GOLF BALL RETRIEVER

BACKGROUND OF THE INVENTION

1. Field of the Invention

The present invention relates to a golf ball retriever, and more particularly to a golf ball retriever which can be removably attached to the butt end grip of a golf club facilitating retrieval of a golf ball.

2. Description of the Prior Art

U.S. Patent 2750222 and U.K. Patent Specification 2128484 disclose golf ball retrievers which are secured to the end of a golf club grip or shaft, such golf ball retrievers having a suction cup adapted to retrieve the golf ball. Such suction cup retrievers rely for their operation on the formation of a partial vacuum between the cup and the golf ball, which is difficult to achieve satisfactorily, particularly under dry conditions.

It is an object of the invention to provide an improved golf ball retriever which can be more easily used to retrieve golf balls.

SUMMARY OF THE INVENTION

According to the present invention, there is provided a golf ball retriever for use with a golf club having a butt end, the golf ball retriever comprising a club engaging portion arranged to engage the butt end of a golf club thereby to secure the retriever to the butt end, and a ball receiving portion comprising a pair of bifurcated arms connected to the club engaging portion, the arms being spaced from one another and deformable resiliently relative to one another to engage and retain a golf ball between said arms.

It is preferred that the club engaging portion and the ball receiving portion are formed integrally, advantageously of plastics, preferably being of molded plastics construction or, as a less preferred alternative, formed from a strip or sheet of plastics material.

In one embodiment, the club engaging portion and ball receiving portion are formed from a single strip or sheet of material whereby the club engaging portion comprises a partially everted portion of the sheet or strip intermediate the arms of the ball receiving portion.

In a further, more preferred, embodiment, the club engaging portion and the ball receiving portion are integrally connected to a median web member which extends transverse to the general longitudinal axis of both the ball receiving portion and the club engaging portion. The ball retriever according to the invention is in this embodiment preferably produced as a unitary injection molding, the vestigial injection sprue being located on the above-mentioned web portion.

Desirably, the arms are provided with inwardly curved or dished portions arranged to conform to and grippingly engage the curved surface of the ball. Advantageously, the inwardly curved or dished portions are provided proximate the distal ends of the arms.

It is preferred that downward pressure applied to the golf ball by the distal ends of the arms causes the arms to deform resiliently away from one another, to accomodate the equator diameter of the ball, and subsequently to close to resume their original position thereby capturing the golf ball. Thus, the ball is held by a snap fit action within the arms, rather than being held by a wedging action.

It is preferred that each of the bifurcated (forked) arms comprise claws (preferably a pair of claws) which are arranged to grip the ball. Advantageously, the distal (free) ends of the claws are pointed. The provision of pointed distal ends for the claws enables four points of initial contact with the dimpled ball to be provided, the four points of contact being spaced about a common line of latitude on the ball. This construction ensures that, in use, it is straightforward to locate a golf ball beneath the accessory prior to the application of downward pressure to grip and retain the ball. Desirably, the distal ends of the claws lie on a circumscribing circle, the diameter of which circumscribing circle is smaller than the equator diameter of the golf ball.

Desirably, the club engaging portion of the golf ball retriever is arranged to provide a push fit on the butt end of the golf club, and advantageously comprises spaced wall portions resiliently deformable relative to one another to grip the butt end between the respective wall portions. Such wall portions are preferably arcuate, being of curvature similar to that of the butt end, with the spacing between the wall portions decreasing with distance from the ball receiving portion such that the butt end is engaged between the wall portions in a wedging action.

It is preferred that the arrangement of the arms and the club engaging portion is such that, when the spaced arms are deformed or flexed toward one another, the spaced wall portions of the club engaging portion are caused to correspondingly resiliently flex or deform away from one another, and vice versa. Such flexing or deformation preferably involves pivotting about end portions of a web portion as described above. As a result of this feature, when the ball is gripped by the arms, the gripping force applied to the butt of the club by the club engaging portion is actually increased. Additionally, when sliding the club engaging portion over the butt end of the club, the spaced wall portions may be temporarily flexed away from one another to ease positioning of the golf ball retriever on the butt end of the club.

The invention will now be further described in a specific embodiment, by way of example only and with reference to the accompanying drawings.

DESCRIPTION OF THE DRAWINGS

FIG. 1 is a perspective view of a golf ball retriever according to the invention;

FIGS. 2 and 3 are side end views respectively of the golf ball retriever of FIG. 1 attached to the butt end of a golf club;

DETAILED DESCRIPTION OF PREFERRED EMBODIMENTS

Figure 4:
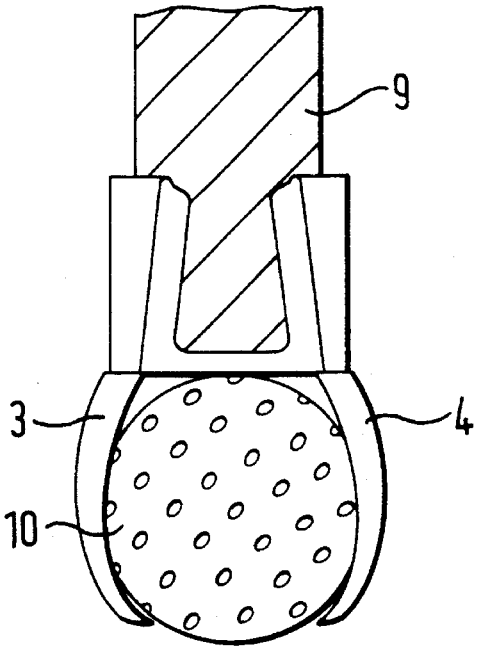
FIGS. 4 and 5 are side and end views corresponding to the views of FIGS. 2 and 3 showing the golf ball retriever in use.
Figure 5:
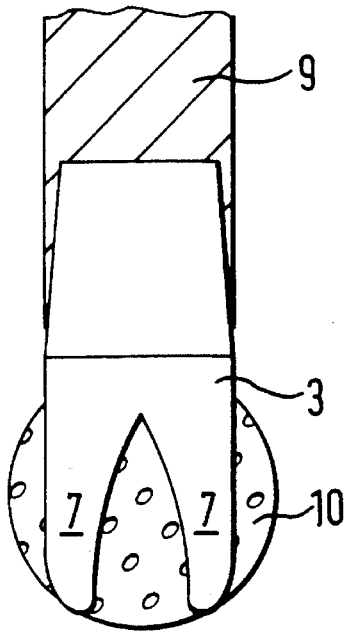

Referring to the drawings, and initially to FIG. 1, there is shown a golf ball retriever generally designated 1. The retriever is formed of plastics material by injection molding and comprises a ball receiving portion 2, having a pair of spaced arms 3,4, and a club engaging portion 14. The club engaging portion 14 is generally "U" shaped in cross section having spaced wall portions 5,6 which in use grippingly engage the butt end of a golf club such that the retriever is a push fit on the butt end of the club.

Arms 3,4 are resiliently deformable either toward, or away from, one another by virtue of the plastics construction of the retriever, as are wall portions 5,6. Respective arms and wall portions 3,5 on one side of the retriever and arms and wall portions 4,6 on the other side of the retriever are connected and arranged to project in respectively opposed directions from a median, interconnecting web portion 11. The web portion 11 includes the vestigial injection sprue (not shown), at a central location.

Connection at the web portion 11 is such that as arms 3,4 are biased toward one another, wall portions 5,6 bias away from one another, and vice versa. Arms 3,4 are both bifurcated to form claws 7. Claws 7 are curved or dished inwardly to more snugly receive and retain the golf ball; the claws terminate in respective points 8 at their distal ends.

In use, the retriever 1 is push fitted to the butt end of a golf club shaft 9 as shown in FIGS. 2 to 5, and the ball receiving portion held immediately above a golf ball 10. When push fitting the retriever to the butt end of the shaft 9, it is useful, in order to ensure ease of fitting, to flex the wall portions 5,6 outwardly relative to one another by correspondingly squeezing the arms 3,4 slightly toward one another as described above. The retriever is then forced downwardly onto the ball 10, such that arms 3,4 deform resiliently outwardly to accomodate the maximum diameter of the ball and subsequently close to receive and retain the ball 10 (as a snap-fit of the ball in the arms). The pointed distal ends of claws 7 initially contact dimples on the surface of the golf ball around a common latitudinal line to ensure correct positioning of the retriever above the ball 10.

With the ball securely held by the retriever, the ball may be lifted from the ground using the butt end of the club, without the need for the golfer to bend or stoop. Subsequently, the ball may be removed from the retriever, and the retriever removed from the butt end of the club.

Figure 6:
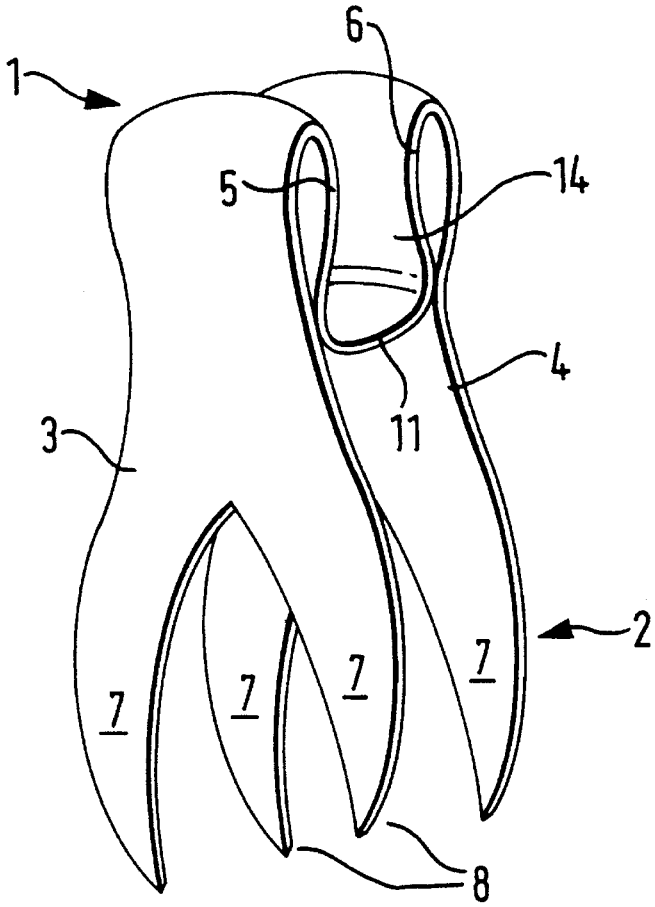
FIG. 6 is a perspective view of an alternative embodiment of a golf ball retriever according to the invention.

Referring to FIG. 6, there is shown an alternative embodiment of a golf ball retriever according to the invention. In this embodiment, the retriever is formed by means of thermal deformation from a single strip or sheet of plastics material whereby the club engaging portion 14 comprises a partially everted portion of the strip or sheet intermediate arms 3,4.

I claim:

1. A golf ball retriever of plastics material for use with a golf club having a shaft with a butt end, said golf ball retriever comprising a club engaging portion having spaced wall members which are resiliently deformable relative to one another and which are arranged to grippingly engage said butt end of said shaft thereby securing said retriever to said butt end, and a ball receiving portion comprising a pair of bifurcated arms integrally connected to said club engaging portion, said pair of bifurcated arms being spaced from one another and deformable resiliently relative to one another for engaging and retaining a golf ball, said arms and said wall portions being such that when said spaced arms are flexed toward one another, said wall portions are caused caused to resiliently deform away from one another.

2. A golf ball retriever according to claim 1, wherein the distal ends of said arms define a circumscribing circle, the diameter of which circumscribing circle is smaller than the equator diameter of said golf ball.

3. A golf ball retriever according to claim 1, wherein said arms are arranged to be deformed resiliently away from one another, so as to accomodate said ball, and subsequently to close to engage and retain said golf ball.

4. A golf ball retriever according to claim 1, wherein said club engaging portion and said ball receiving portion are formed integrally with one another.

5. A golf ball retriever according to claim 1, wherein said arms are provided with inwardly curved or dished portions arranged to conform to and engage the curved surface of said ball.

6. A golf ball retriever according to claim 5, wherein said inwardly curved or dished portions are provided proximate the distal ends of the arms.

7. A golf ball retriever according to claim 1, wherein each of said arms comprises claws arranged to grip the ball.

8. A golf ball retriever according to claim 7, wherein said ends of said claws are pointed at their distal ends.

9. A golf ball retriever according to claim 1, wherein said club engaging portion is arranged to be a push fit on said butt end of said golf club and to retain said butt end by means of a wedging action.

10. A golf ball retriever according to claim 1, wherein said club engaging portion and said ball receiving portion are integrally connected to a median web member which extends transverse to the general longitudinal axis of both said ball receiving portion and said club engaging portion.

11. A golf ball retriever according to claim 10, which is in the form of a unitary injection molding.

12. A golf ball retriever for use with a golf club having a shaft with a butt end, said golf ball retriever comprising:

(a) a club gripping portion having a longitudinal axis and comprising spaced wall members being resiliently deformable towards and away from one another, said wall members being shaped and dimensioned for gripping said butt end;

(b) a ball receiving portion for receiving a golf ball having a substantially spherical outer surface, said ball receiving portion having a longitudinal axis substantially coaxial with the longitudinal axis of said club gripping portion, said ball receiving portion comprising a pair of bifurcated arms, a first of said pair of arms being spaced from a second of said pair of arms, said pair of arms being resiliently deformable respectively towards and away from one another and having concave internal faces shaped for conforming to, and engaging with, said substantially spherical outer surface and for retaining said golf ball between said concave internal faces; and, (c) a median web member extending transversely to said longitudinal axis, said ball receiving portion, said club gripping portion and said median web member all being integrally formed and connected to one another as a unitary molding; and, said pair of bifurcated arms and said wall members being such that when said pair of bifurcated arms are resiliently deformed towards one another, said wall members are caused to resiliently deform away from one another and to relax the grip on said butt end.

13. A golf ball retriever according to claim 12, wherein distal ends of said pair of bifurcated arms define a circumscribing circle, the diameter of which circle is smaller than, and extends beyond, the equatorial diameter of said golf ball.

14. A golf ball retriever according to claim 12, wherein each of said pair of bifurcated arms comprises a pair of claws, each of said claws being pointed at its distal end.

* * * * *